United States Patent [19]

Ferrari

[11] 4,444,804

[45] Apr. 24, 1984

[54] FLAME SPRAYED COATINGS

[75] Inventor: Gregory P. Ferrari, Leavesden, England

[73] Assignee: Rolls-Royce Limited, London, England

[21] Appl. No.: 463,953

[22] Filed: Feb. 4, 1983

[30] Foreign Application Priority Data

Mar. 6, 1982 [GB] United Kingdom ..... 8206660

[51] Int. Cl.[3] ..... B05D 1/00

[52] U.S. Cl. ..... 427/34; 427/270; 427/423

[58] Field of Search ..... 427/34, 423, 270

[56] References Cited

U.S. PATENT DOCUMENTS

| | | | |
|---|---|---|---|
| 2,958,609 | 11/1960 | Stoll et al. | 427/423 |
| 3,759,739 | 9/1973 | Varlas | 427/423 X |
| 3,981,155 | 9/1976 | Kroebig | 427/34 X |
| 4,198,442 | 4/1980 | Gupta et al. | 427/34 |

FOREIGN PATENT DOCUMENTS

| | | | |
|---|---|---|---|
| 56-127449 | 10/1981 | Japan | 427/423 |
| 956740 | 4/1964 | United Kingdom . | |
| 979746 | 1/1965 | United Kingdom . | |
| 1272691 | 5/1972 | United Kingdom . | |
| 1318209 | 5/1973 | United Kingdom . | |
| 1356017 | 6/1974 | United Kingdom . | |

*Primary Examiner*—Thurman K. Page

*Attorney, Agent, or Firm*—Cushman, Darby & Cushman

[57] ABSTRACT

A method of sealing a flame sprayed metal or metal containing coating on a metal substrate in which the deposited coating is saturated with an anaerobically curable sealant such as a polymethacrylic ester with an amine catalyst which has a viscosity of up to 25 centipoises. After the sealant has been applied to the coating, excess sealant is wiped off the coating surface and the sealant is cured. The sealant prevents the absorption of water by the flame sprayed coating and hence corrosion of the metal substrate.

3 Claims, No Drawings

FLAME SPRAYED COATINGS

This invention relates to flame sprayed coatings.

It is well known to provide a metal component with a coating by the technique known as flame spraying. In that technique, finely divided metal particles or particles containing a metal which have been heated by the combustion of certain gases or by a plasma arc are propelled on to the surface of the component. The metal particles adhere to the surface and to each other to build up a generally porous coating on the surface of the component. Such coatings may be applied for a variety of purposes but are mainly intended to either protect the component surface or build up the surface if, for instance the component is undersize as a result of wear.

One of the problems associated with flame sprayed coatings results from their porous nature. Thus if the flame sprayed component is exposed in operation to a humid atmosphere or to water spray, water tends to be absorbed and retained by the sprayed coating which leads in turn to the corrosion of the metal component surface and subsequent loss of the coating. The problem is particularly acute in the case of flame sprayed components which are made from magnesium or magnesium based alloys and are exposed in use to salt water spray.

It is an object of the present invention to provide a method of providing a flame sprayed metal coating on a metal substrate in which the resistance to corrosion of the substrate is improved.

According to the present invention, a method of providing a a flame sprayed metal or metal containing coating on a metal substrate comprises the subsequent steps of flame spraying finely divided metal particles or metal containing finely divided particles on to a metal substrate until a coating of the required thickness has been deposited thereon, cooling said coated substrate and applying to said coating an anaerobically curable sealant having a viscosity of up to 25 centipoises in such an amount as to saturate said coating, removing excess sealant from the surface of said coating and curing said sealant.

The application of the curable sealant to the deposited coating until the coating is saturated ensures that substantially all of the pores within the coating are filled with the sealant. Consequently elimination of the coating porosity ensures that the coating will not subsequently absorb water, thereby avoiding the possibility of the metal substrate corroding as a result of electrochemical interaction between the metals of the coating and substrate.

The sealant is one which is anaerobically curable, that is, one which cures upon the elimination of oxygen from its surrounding atmosphere. Consequently when the sealant is absorbed by the porous coating, air is driven from the coating pores, thereby promoting the curing of the sealant. The preferred anaerobic sealant is polymethacrylic ester with an amine catalyst which has a viscosity of approximately 15 centipoises. However we have found that sealants with viscosities of up to 25 centipoises are suitable for use in the method of the present invention. If the sealant viscosity is greater than 25 centipoises, we have found that there is incomplete absorption of the sealant by the porous coating. This leaves pores in the coating which, after curing of the sealant, leads to the possibility that the pores will subsequently absorb water, thereby leading in turn to the corrosion of the substrate.

The curable sealant may be applied to the deposited coating by any convenient method which facilitates the saturation of the coating. Thus mention may be made of immersing the coated substrate in a bath of the sealant, spraying the sealant on to the coating and applying the sealant by the use of a dropper bottle or a brush. It is important however that whatever method is used, substantially complete saturation of the coating must be achieved so as to eliminate the possibility of pores being left in the coating. Thus a good indication of the saturation of the coating with the sealant is when the coating takes on a glossy appearance.

After application of the sealant, excess sealant is removed from the surface of the coating by any convenient method. However we have found that wiping the coating surface with a cloth is usually effective in removing excess sealant. Removal of the excess sealant ensures that the dimensions of the deposited coating are not affected by its treatment with the sealant.

It is sometimes necessary to machine flame sprayed coatings prior to the use of the component to which they have been applied. In these circumstances it is still necessary to apply the sealant to the deposited coating as soon as cooling of the coated substrate has been achieved. This is to ensure that after flame spraying, as little water vapour as possible is absorbed by the deposited coating prior to the application of the sealant thereto. If water vapour is absorbed in any quantity, it is trapped within the coating by the subsequent application of the sealant, thereby leading to the risk of later corrosion.

After the sealant has been applied to the deposited coating and cured, any desired machining of the coating may be carried out. When the machinery operation has been completed, more of the sealant is applied to coating until saturation is indicated by a glossy coating surface. Excess sealant is then removed from the coating surface as before. This second application of sealant is necessary to ensure that there is complete sealant penetration of the surface coating and also to ensure that any porosity that has been created as a result of the machining operation is eliminated.

If it is found necessary to use a lubricant during the machining of the deposited coating, it is important that any traces of the lubricant which may remain after the machining operation has been completed are removed prior to the second application of the sealant. This is conveniently achieved by treating the machined coating with a suitable organic solvent which will not attack the sealant which has already been applied and then heating the coating to a temperature, usually between 100 and 200° C., at which the solvent is driven off without any decomposition of the sealant.

The following tests were carried out in order to investigate the corrosion inhibiting properties of coatings produced in accordance with the method of the present invention.

Ten test pieces made from a magnesium based alloy containing aluminium and zirconium were machined so that each provided a rectangular face measuring 4 inches by 1 inch. The machined forces where then grit blasted before being plasma sprayed with nickel aluminide flame spray particles (Metco 450) to a depth of 0.020 inches. Six of the flame sprayed test pieces were allowed to cool in air before being immersed in the anaerobic curing sealant marketed as Loctite 290 by Loctite (U.K.) Limited (Loctite is a registered trade mark). Loctite is a di-methacrylic ester having a viscosity of 10–15 cP, a specific gravity of 1.07, and a flash-point (COC) of >100° C.

The six test pieces were then removed from the sealant and examined in order to check whether the coating surface was glossy indicating that saturation of the plasma sprayed coating had been achieved. Excess sealant was then wiped off the coating surface using a cloth. The saturated test pieces were then left for approximately four hours to permit curing of the sealant to take place. The ten test piece surfaces were then subjected to a machining operation in which two grooves 0.20 and 0.40 mm respectively were machined in each test piece face.

The test pieces were then subjected to cyclic corrosion testing in which each test piece was immersed in artificial sea water for two hours followed by emmersion for two hours at a temperature of 35° C. on a continuous re-cycling basis.

The results were as follows:

1. After 3.5 hours (a) Unsealed test pieces

All four unsealed test pieces showed salt incrustation with evidence of magnesium corrosion products. Blistering of the flame spray coating was observed as was the light evolution of hydrogen.

(b) Sealed test pieces

All six test pieces showed light salt incrustation with evidence of magnesium corrosion products. Light evolution of hydrogen was observed and four of the test pieces showed evidence of blistering of the metal spray coating.

2. After 20 hours (a) Unsealed test pieces

The flame sprayed coating had completely lifted off the test pieces as a result the formation of corrosion products on the test piece surface. Considerable salt incrustation and high evolution of hydrogen were observed.

(b) Sealed test pieces

The flame sprayed coating on each test piece had been partially lifted by blistering leaving some 40 to 50% by area of the coating still satisfactorily bonded to each test piece.

3. After 27.5 hours (a) Unsealed test pieces

As after 20 hours but had progressed further.

(b) Sealed test pieces

Four test pieces still had areas of intact flame sprayed coating but had become heavily incrusted with salts and corrosion products. The remaining two test pieces where also intact but were showing evidence of the evolution of hydrogen.

4. After 70 hours (a) Unsealed test pieces

Evidence of further progression of corrosion and cavitation of the test pieces was observed.

(b) Sealed test pieces

Areas of flame sprayed coating on each test piece were still intact and incrusted with salts and corrosion products. Two test pieces were evolving low levels of hydrogen.

The test was terminated at this stage.

It will be seen from the results of the test that the test pieces which had been sealed in accordance with the method of the present invention had superior corrosion resistance to those which had not so sealed.

It will be understood that although the present invention has been described with reference to a flame sprayed coating which is exclusively metallic, the method of the present invention is also applicable to flame sprayed coatings which are not exclusively metallic, for instance those which contain a metal in combination with a ceramic, glass or plastic.

I claim:

1. A method of providing a flame sprayed metal or metal containing coating on a metal substrate comprising the subsequent steps of flame spraying finely divided metal particles or metal containing finely divided particles on to a metal substrate until a coating of the required thickness has been deposited thereon, cooling the coated substrate and applying to said coating an anaerobically curable sealant of a polymethacrylic ester with an amine catalyst and having a viscosity of up to 25 centipoises in such an amount as to saturate said coating, removing excess sealant from the surface of said coating and curing said sealant.

2. A method of providing a flame sprayed metal or metal containing coating on a metal substrate as claimed in claim 1 wherein the viscosity of said sealant is approximately 15 centipoises.

3. A method of providing a flame sprayed metal or metal containing coating on a metal substrate as claimed in claim 1 wherein said coating is machined after said sealant has been cured, further of said sealant being applied to said coating surfaced after said machining so as to ensure that said coating is saturated, excess sealant being removed from said coating surface prior to the curing of said further applied sealant.

* * * * *